US007712259B1

(12) United States Patent
Pettesch

(10) Patent No.: US 7,712,259 B1
(45) Date of Patent: May 11, 2010

(54) SUMP COVER SYSTEM FOR UNDERGROUND LIQUID STORAGE TANKS

(75) Inventor: Martin C. Pettesch, Cranford, NJ (US)

(73) Assignee: Universal Valve Co., Inc., Elizabeth, NJ (US)

( * ) Notice: Subject to any disclaimer, the term of this patent is extended or adjusted under 35 U.S.C. 154(b) by 0 days.

(21) Appl. No.: 11/975,705

(22) Filed: Oct. 20, 2007

(51) Int. Cl.
*E02D 29/14* (2006.01)

(52) U.S. Cl. ..... 52/20; 52/19; 404/25; 404/26

(58) Field of Classification Search ..... 52/19, 52/20, 169.6, 200; 404/25, 26
See application file for complete search history.

(56) References Cited

U.S. PATENT DOCUMENTS 1,889,056 A * 11/1932 Blanchard ..... 70/169
3,017,721 A * 1/1962 Wasserman ..... 52/1
4,703,592 A * 11/1987 Sampson et al. ..... 52/20
5,311,966 A * 5/1994 Daniels ..... 182/128
5,650,065 A * 7/1997 Sewell ..... 210/166
5,951,200 A * 9/1999 Barton ..... 404/25
5,966,876 A * 10/1999 Neathery et al. ..... 52/20
6,527,476 B1 3/2003 Pettesch
2002/0124490 A1 * 9/2002 McCarthy ..... 52/169.6

OTHER PUBLICATIONS

Author unknown, "Universal Sump Retro-Fit Lids," Blueline Technologies, LLC catalog, Published by Petroleum Equipment Institute online.

* cited by examiner

*Primary Examiner*—Richard E Chilcot, Jr.
*Assistant Examiner*—Anthony N Bartosik
(74) *Attorney, Agent, or Firm*—Edward Dreyfus, Esq.

(57) ABSTRACT

A quick, field installed sump cover system for below ground sumps includes a support ring, a seal between the ring and sump upper lip, preferably two compression brackets each having two spaced regions extending under riser parts, at least one elongated member coupled between the support ring and compression brackets for selectively applying tension forces therebetween causing the bracket regions to engage the riser parts and the support ring to compresses the sealing member to form liquid-tight seal with the sump lip. The sump top can be closed by a dome-cover removably coupled to the support ring. The elongated members can include chain-like members with tensioning devices that, in field installations, can accommodate various sump sizes.

9 Claims, 4 Drawing Sheets

DETAIL A

SUMP COVER SYSTEM FOR UNDERGROUND LIQUID STORAGE TANKS

RELATED APPLICATION

FIELD OF THE INVENTION

The present invention relates to underground liquid fuel storage tanks and, more particularly, to new and improved covering system for underground fuel storage tanks.

BACKGROUND OF INVENTION

Underground fuel storage tanks are required by law to prevent liquid leaks below ground to avoid soil and groundwater contamination. To meet this requirement, tanks conventionally include a water tight sump shield assembly that collects any fuel leakage from pipes, valves, or other equipment at the upper part of the tank. Sensors and alarms are also provided as an alert to such condition. Water that enters the sump, for alarmed base sumps, is occasionally falsely sensed as a fuel leak, requiring immediate examination and corrective action.

It is known in the art that the covers for sump assemblies cannot remain properly sealed against rain and other water runoff. Such runoff seeks the lowest level and can enter the sump assembly. This water when mixed with the aforementioned fuel leakage also creates a contaminated condition that must be dealt with promptly. This condition wastes much time and effort, and, therefore, expense to deal with recurring contamination. More seriously, as described below, the cover sealing problem becomes worse over time to the point when the sump can fill completely with water run-off and fuel mixture. This can lead to an overflow of fuel-contaminated water that can contaminate surrounding soil often leading to fines, contamination clean-up, and the expense of digging up the concrete-imbedded leaking assembly and replacing it with a new sump assembly and concrete.

The principal cause of the above problems stems from the standard sump covers, which do not provide a seal strong or reliable enough to prevent water from entering the containment sump. Weak cover seals can result from poor design, poor installation, poor materials, and the like.

Many sumps are made of polyethylene or other plastics. Cover leakage also results from installed or migrating back fill or concrete, which initially or over time, compresses the sump into an egg-shape or other distortion. The plastic under constant pressure tends to flow and distort causing the distorted sump opening lip to breech the circular, metal cover seal.

Sump assembly manufacturers have tried to overcome these problems, such as providing a unit that seals on the inside surface of the sump by means of an expandable plug design. Unfortunately, each unit needs to be customized to fit a particular design criterion, such as size of the collar opening, etc. If the unit distorts in the field, then the operator must wait until a new plug is manufactured to the new dimensions, which may result in fines, shut-down, or contamination. Thus, customizing for each unit increases the costs of the product and requires complex and delayed supply practices.

Another commercial unit relies on epoxies or other adhesives to seal the cover to the collar lip. Bonding materials compatible with polyethylene have only recently been introduced to the market. But these materials are not compatible with fuel hydrocarbons and may themselves contaminate the fuel being pumped or stored.

Accordingly, there is a need for a fuel storage containment sump shield assembly that provides a watertight seal over a long period of time to prevent water from entering the containment sump assembly for underground fuel storage tanks.

SUMMARY OF EXEMPLARY EMBODIMENT OF INVENTION

The present invention solves the above mentioned problems and provides a sump cover system that is quickly installed, excellently sealed against liquid intrusion, designed to fit a wide variety of sump dimensions, and, if necessary, is easily disassembled and re-assembled.

One exemplary embodiment of the invention includes a support ring with a wide sealing member, EG gasket, which seats on the sump upper lip; one or two compression brackets are placed below the riser of the sump. Elongated members, that can have adjustable lengths, extend from the compression brackets and attach to spaced zones of the support ring. Each elongated member includes a shortening or tension device, such as a turn buckle. As the elongated member is shortened, the top of the compression bracket engages the riser. Further tightening or turning the turn buckle compresses the support ring on to the sealing member, and, in turn, the sealing member on to the sump collar lip to achieve a liquid-tight seal.

A cover is secured to the support ring by suitable devices, such as fasteners or the like. In one example, the top of the support ring includes a number of upstanding threaded studs. The cover, preferably dome-shaped, has an outer lip region that includes a series of openings that marry to the number of threaded studs. The cover is installed by placing the cover in to the support ring with the studs extending through the openings. Wing or other nuts can be threaded to the studs to secure the cover on to the support ring. Preferably, the cover can also include a port for inspection or some access to the sump interior without disassembling the system. The port can be closed with a removable but sealing port cover and port gasket.

DESCRIPTION OF THE DRAWINGS

Other and further objects, advantages, and benefits of the present invention shall become apparent with the following detailed description of an exemplary embodiment according top the principals of the present invention, when taken with the appended drawings, in which.

DETAILED DESCRIPTION OF EXEMPLARY EMBODIMENTS OF THE INVENTION

Figure 2:
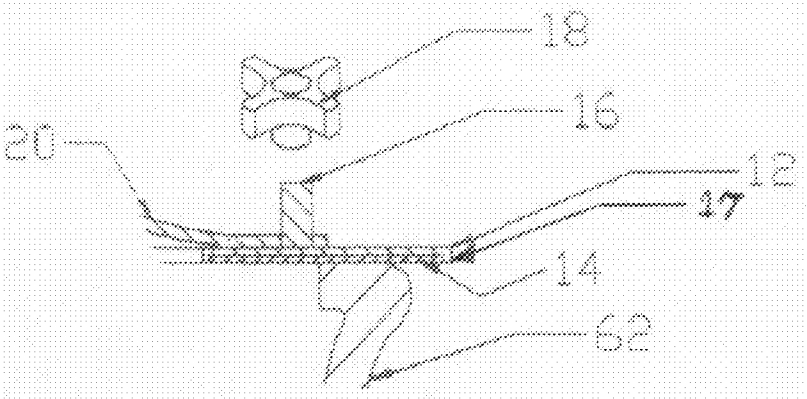
FIG. 2 is the same view of "Detail A" in FIG. 1.
Figure 1:
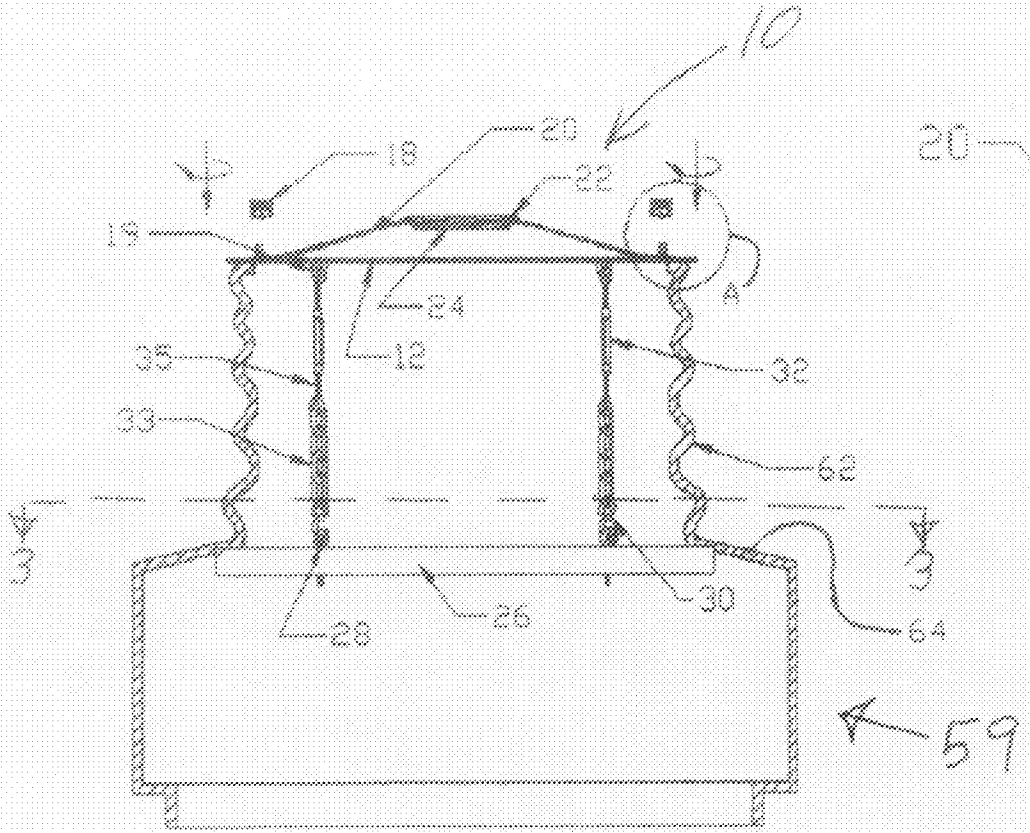
FIG. 1 is a side elevation, vertical section of a typical below ground sump including an installed exemplary embodiment of the cover system 10 according to the principles of the present invention. The vertical section is along line 1-1 of FIG. 3. The vertical and circular arrows show the tightening rotation of wing nuts 18 on to studs 16.
Figure 3:
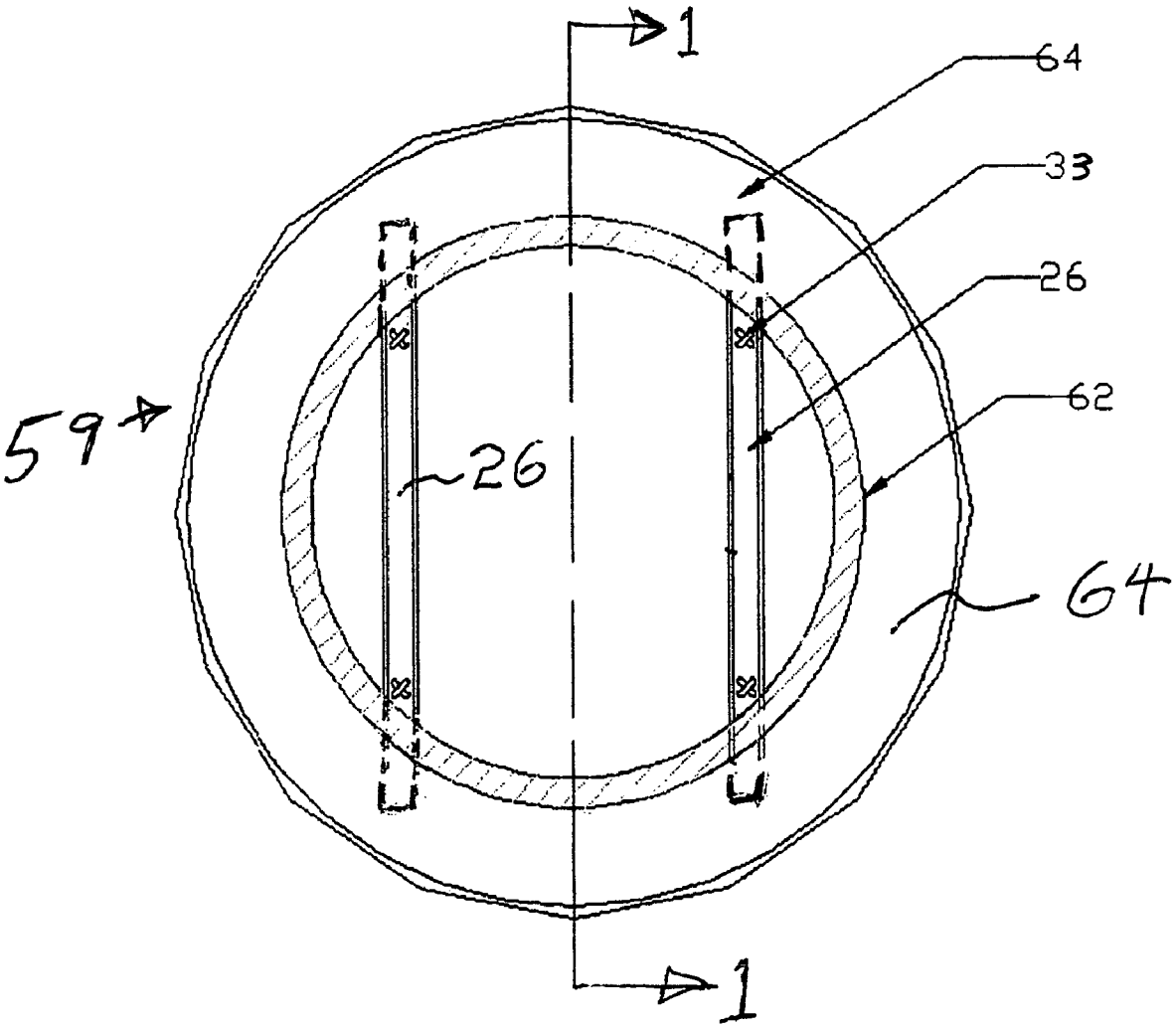
FIG. 3 is a horizontal section taken along line 3-3 of FIG. 1.
Figure 4:
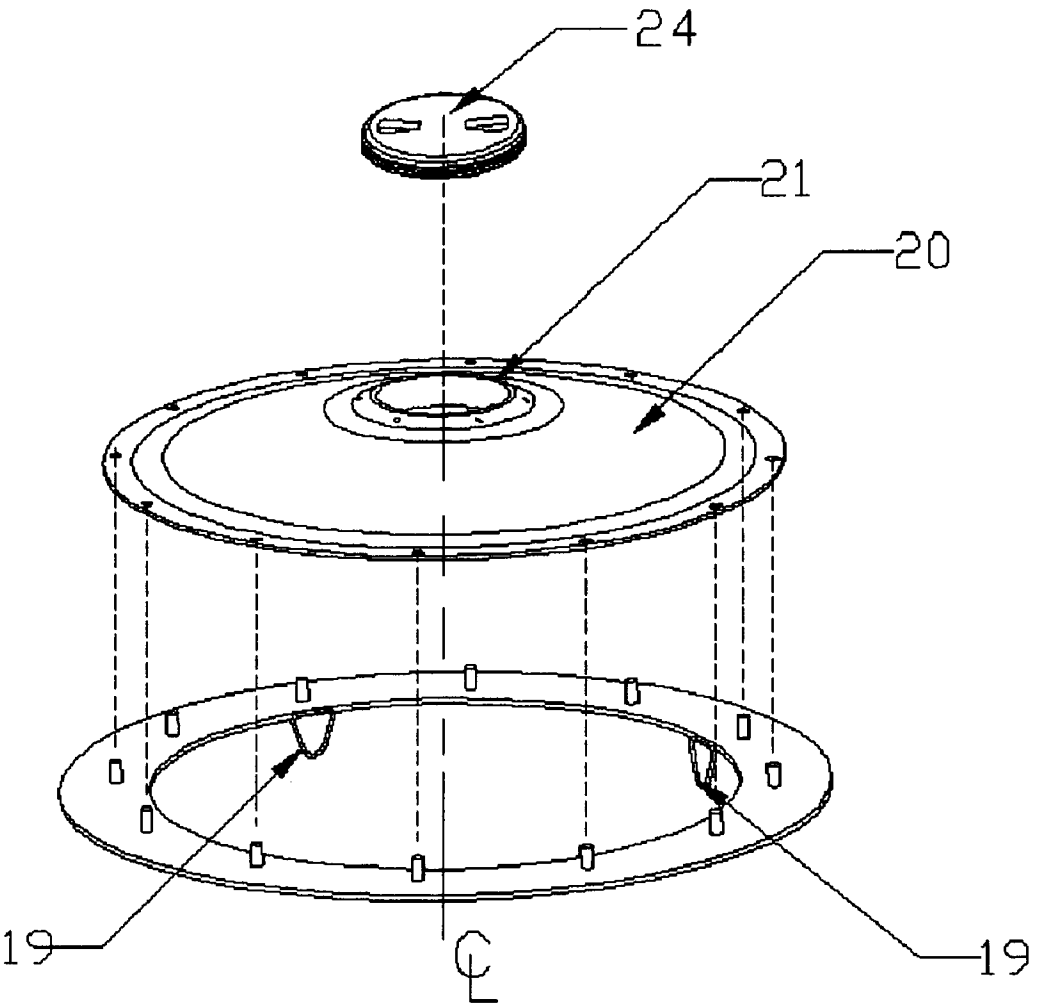
FIG. 4 is a perspective, exploded view of the support ring, sump cover, and port cover of FIG. 1.

With reference to FIGS. 1-4, a system 10 according to the principles of the present invention is shown installed on a sump 59 having a collar 62 and a riser 64. System 10 includes support ring 12 having a series of spaced, upstanding, threaded studs 16 on its top surface and a depending lip 17 at its outer periphery. Gasket 14 locates between ring 12 and the top ridge or lip of collar 62. Ring 12 also includes attachment holes (not shown) or devices, such as D hooks 19, for connection to the upper parts of the elongated members, such as turn buckles 32 and chains 33. Cover 20 is preferably dome-shaped with a horizontal outer lip region that installs on to ring 12. Cover 20 includes a series of openings that receive the series of studs 16. Wing nuts 18 secure to cover to ring 12.

One or more compression brackets 26 are spaced laterally from the sump diameter preferably on opposite sides of the same diameter. Brackets 26 engage riser 64 from below and are secured by elongated members 35 extending from brackets 26 to the support ring 12. Elongated members 35 serve to apply upward force on brackets 26 compressing their upper end into engagement with rise 64 underside. Tension members 35, in this example, include turn buckles 32 having their upper end connected to D hooks 19 and a length of chain 33, cord, or rod extending from turn buckle 32 lower end to an eye-hook 28 threaded, welded, or bolted or otherwise connected to compression bracket 26. If desired, "S" hooks 30 may be used to connect chain 33 to bracket 26, generally as shown. Ring 12 and gasket 14 form an excellent seal with the top of the collar 62 because the gasket is compressed between the ring 12 and top lip of collar 62 due to the tension applied to the tension member 35 by turn buckle 32.

Cover 20 can also include inner walls 22 that define an inspection or access port preferably at the top of the cover 20. Walls 22 can be threaded or otherwise designed to receive a port cover 24 to seal the port until access to the port is desired.

Sump Cover System Installation

The system installation shall now be described starting with a top exposed, below ground sump. One embodiment of the present invention fits sumps from 27" to 34" in diameter, however additional sizes can be accommodated without departing from the present invention. The installation takes a few minutes, requires no adhesive or epoxy, and usually requires only an adjustable wrench tool, a measuring tape or ruler, and potentially a metal saw or cutting tool. Steps 4A, B, & C below are in the alternative.

Installation steps can generally include:

Step 1. Determine if the system cover will fit by measuring the diameter of the collar lip. One exemplary embodiment of the invention will fit sump diameters of 27" to 34".

Step 2. Place the support ring 12 on top of the sump 62 lip with studs 16 facing upward. In the unlikely event the top lip of collar 62 is not flat and has a recess of greater than one-quarter inch, a hand or air operated plane can be used to level the lip surface.

Step 3. Before or after step 2 above, measure the height of the sump collar from about the top of the riser 64 to the top of the sump collar. This height shall determine which suspension configuration, more fully described below, will optimize the system reliability and integrity.

Step 4A. If the height of collar 62 is greater than 10 inches, see FIG. 1. Extend the turn buckles fully by screwing or rotating them outward. Connect the bottom of turn buckle 32 to the top of the length of chain 33. Hold the chain assembly and place it inside the sump and connect the top of turn buckle 32 to the D-hook 19. Lower the chain into the sump. Lower bracket 26 into the sump and pull up to engage the bracket ends with riser 64. Slip an S-hook 30 through a chain 33 link and the other end of the S-hook 30 through hook 28 of bracket 26. Repeat for the other tension member 35 to suspend bracket 26 from the two associated tension members 35. Then retract turn buckles 32 to apply upward force on bracket 26 until its ends engage riser 64 with suitable compression force causing ring 12 to compress gasket 14 against sump collar 62 lip thus forming a reliable liquid seal at the collar 62 top. This completes installation of that respective bracket assembly. It is recommended that excess chain lengths be cut and removed from the sump to avoid interference with housed equipment or maintenance thereof.

Figure 5:
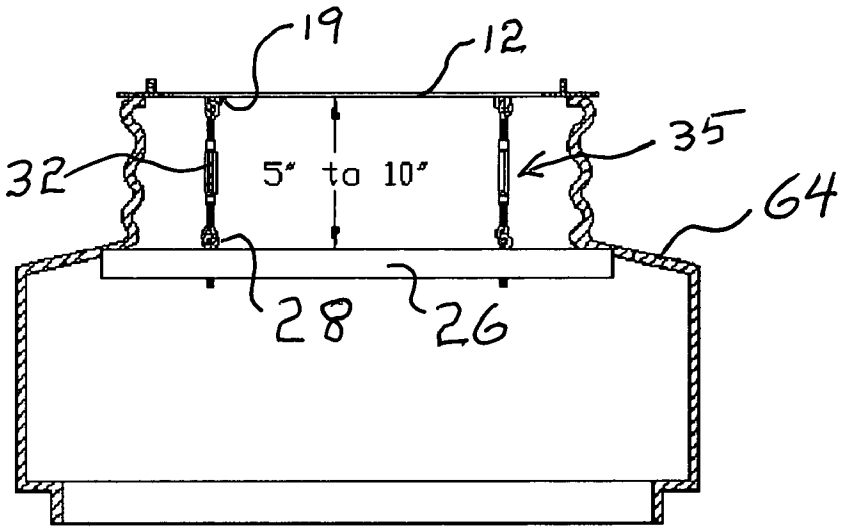
FIG. 5 is similar to FIG. 1 (without cover 20) showing the bracket and support ring assembly for a sump having a medium height collar.

Step 4B. If the height of the collar is 5"-10", see FIG. 5. Use of the chains is unnecessary, and the turn buckles 32 are connected directly between bracket hooks 28 and D-hooks 19. S-hooks 30 may or may not be used as desired. Installation is similar to that described above, except elongated members 35 need not include chains, cords, or the like. Brackets 26 are forced against riser 64 by retracting turn buckles 32 to complete the bracket assembly installation and gasket seal at the sump collar top lip.

Figure 6:
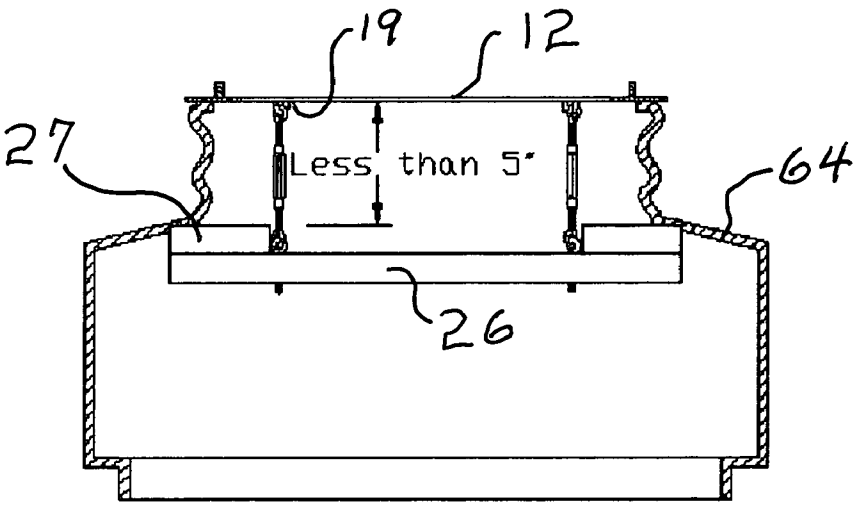
FIG. 6 is similar to FIG. 5 for a sump having a minimum height collar.

Step 4C. If the height of the collar is less than 5", see FIG. 6. Use of the chains is unnecessary. Turn buckles 32 are connected directly between bracket hooks 28 and D-hooks 19. Either a smaller sized turn buckle can be used or, alternatively, spacer blocks 27 can be placed on the outer ends of brackets 26, which blocks 27 become compressed between riser 64 and bracket 26 when turn buckles 32 are screwed for retraction causing ring 12 to compress gasket 14 against collar 62 top lip forming a reliable liquid seal therewith.

Step 5. Regardless of the configuration of the suspension/compression configuration, the system installation is completed by installing the sump cover 20 with wing nuts 18 screwed down on studs 16, and threading port cover 24 on to the access port 22.

It will be understood that various modifications and enhancements and changes may be made to the various herein disclosed exemplary embodiments without departing from the spirit and scope of the present invention. The collar and other dimensions stated above are exemplary and should not be taken as limiting the application of the present invention. The drawings are not necessarily drawn to scale but are designed to more clearly illustrate the functionality and features of the principles of the present invention. Although the above exemplary embodiments include corrugated plastic sumps, the invention is also applicable for metal sumps and non-corrugated sumps.

What is claimed is:

1. A sump cover system for a sump, said cover system having a riser and a collar, said collar having a top forming an upper lip having an outer periphery, the cover system further comprising:

a support ring having a central opening and an outer periphery greater than the outer periphery of said upper lip and seated on and extending outward beyond said upper lip outer periphery for directing outward beyond said collar liquid that flows outward and on to said support ring, a sump cover overlying said support ring for covering said central opening, a sealing member for forming a liquid tight seal between said support ring and said upper lip, at least one compression bracket having at least two spaced regions extending under at least two spaced parts of said riser, at least one elongated member coupled directly to said support ring and coupled to said compression bracket for selectively providing at least one tension force between said support ring and said compression bracket, and wherein said support ring compresses said sealing member to form the liquid tight seal and said at least two spaced regions engage said at least two spaced parts in response to the tension forces applied by said at least one elongated member, wherein said sump cover is removable to enable access to the sump through said central opening while maintaining the at least one tension force between said support ring and said at least one compression bracket.

2. A sump cover system as set forth in claim 1, wherein said sump cover includes an access port, and an access port cover for selectively closing and allowing access through said access port.

3. A sump cover system as set forth in claim 1, wherein said sump cover includes an outer lip portion for overlying and contacting said support ring and for being releasably connected to said support ring and said outer lip portion having an outer periphery less than the outer periphery of said support ring.

4. A sump cover system as set forth in claim 1, wherein said sump cover diverts liquid flowing on to said sump cover outward on to said support ring.

5. A sump cover system as set forth in claim 1, further including at least a second compression bracket having at least two spaced second regions extending under at least two spaced second parts of said riser, at least one elongated second member coupled to said support ring and coupled to said second compression bracket for selectively providing at least one second tension force between said support ring and said second compression bracket, and wherein said at least two spaced second regions engage said at least two spaced second parts in response to the second tension force applied by said at least one elongated second member, and wherein said at least one compression bracket and said at least one second compression bracket being substantially spaced from each other to enable access to the sump while installed.

6. A sump cover system as set forth in claim 5, wherein said at least one elongated member and said at least one elongated second member respectively comprises a first and second device for selectively shortening and extending the length of said at least one elongated member and said at least one elongated second member, respectively.

7. A sump cover system as set forth in claim 1, wherein said at least one compression bracket includes two spacer blocks for selectively locating at spaced portions of said at least one compression bracket, wherein said spacer blocks become compressed between said spaced portions of said at least one compression bracket and said riser in response to said at least one elongated member applying tension force to said at least one compression bracket.

8. A sump cover system as set forth in claim 1, wherein said at least one elongated member includes a turnbuckle and a length of a flexible, fixed length member coupled in series between said support ring and said at least one compression bracket.

9. A sump cover system as set forth in claim 1, wherein said at least one compression bracket comprises two laterally spaced compression brackets and said at least one elongated member includes at least two elongated members respectively coupled between respective ones of said two laterally spaced compression brackets and said support ring.

* * * * *